US011248319B2

(12) United States Patent
Harada et al.

(10) Patent No.: US 11,248,319 B2
(45) Date of Patent: Feb. 15, 2022

(54) FLAME-RESISTANT WOVEN FABRIC

(71) Applicant: Toray Industries, Inc., Tokyo (JP)

(72) Inventors: Masaru Harada, Otsu (JP); Hiroshi Tsuchikura, Otsu (JP)

(73) Assignee: Toray Industries, Inc., Tokyo (JP)

( * ) Notice: Subject to any disclaimer, the term of this patent is extended or adjusted under 35 U.S.C. 154(b) by 250 days.

(21) Appl. No.: 16/339,062

(22) PCT Filed: Sep. 27, 2017

(86) PCT No.: PCT/JP2017/035047
§ 371 (c)(1),
(2) Date: Apr. 3, 2019

(87) PCT Pub. No.: WO2018/066438
PCT Pub. Date: Apr. 12, 2018

(65) Prior Publication Data

US 2020/0224341 A1 Jul. 16, 2020

(30) Foreign Application Priority Data

Oct. 5, 2016 (JP) ..... JP2016-197071

(51) Int. Cl.
*D03D 15/12* (2006.01)
*D02G 3/44* (2006.01)
(Continued)

(52) U.S. Cl.
CPC ..... *D03D 15/513* (2021.01); *D02G 3/045* (2013.01); *D02G 3/443* (2013.01);
(Continued)

(58) Field of Classification Search
None
See application file for complete search history.

(56) References Cited

U.S. PATENT DOCUMENTS

2012/0042442 A1 2/2012 Takahashi et al.
2013/0045653 A1* 2/2013 Takahashi ..... D03D 13/008 442/301

FOREIGN PATENT DOCUMENTS

CN 102378835 A 3/2012
CN 104499161 A 4/2015
(Continued)

OTHER PUBLICATIONS

"Development of Chinachar(39)s Chemical Fiber Industry Technology: Answer to Equi", pp. 183-198, edited by Li Rui, China Textile Publishing House, Oct. 31, 2004.
(Continued)

*Primary Examiner* — Shawn Mckinnon
(74) *Attorney, Agent, or Firm* — DLA Piper LLP (US)

(57) ABSTRACT

A flame resistant woven fabric has a thickness of 0.08 mm or more in accordance with the method of JIS L 1096-A (2010) and including warps and wefts, the warp and the weft each comprising: a non-melting fiber A having a high-temperature shrinkage rate of 3% or less; and a thermoplastic fiber B having an LOI value of 25 or more in accordance with JIS K 7201-2 (2007) and having a melting point lower than the ignition temperature of the non-melting fiber A; wherein the warp and the weft each have a fracture elongation of 5% or more; and wherein, in the projection area of the weave repeat of the flame resistant woven fabric, the area ratio of the non-melting fiber A is 10% or more and the area ratio of the thermoplastic fiber B is 5% or more.

2 Claims, 2 Drawing Sheets

(51) Int. Cl.

| | |
|---|---|
| ***D02G 3/02*** | (2006.01) |
| ***D03D 15/513*** | (2021.01) |
| ***D02G 3/04*** | (2006.01) |

(52) U.S. Cl.
CPC ..... *D10B 2201/22* (2013.01); *D10B 2331/04* (2013.01); *D10B 2331/301* (2013.01)

(56) References Cited

FOREIGN PATENT DOCUMENTS

| | | | |
|---|---|---|---|
| CN | 104651997 | A | 5/2015 |
| EP | 3 109 351 | A1 | 12/1916 |
| JP | 01-272836 | A | 10/1989 |
| JP | 11-293542 | A | 10/1999 |
| JP | 2005-334525 | A | 12/2005 |
| JP | 2007-092209 | A | 4/2007 |
| JP | 2007-099209 | A | 4/2007 |
| JP | 2012-036511 | A | 2/2012 |
| JP | 2014-159666 | A | 9/2014 |
| JP | 2015-229805 | A | 12/2015 |
| JP | 2017-201063 | A | 11/2017 |
| WO | 2012/102090 | A1 | 8/2012 |

OTHER PUBLICATIONS

*New Fiber Materials Science*, pp. 280-282, edited by Ho Jianxin et al., Donghua University Press, Jul. 31, 2014.

Textile Materials, pp. 149-150, edited by Weidong, China Textile Publishing House, May 31, 2006.

The Second Office Action dated Aug. 20, 2020, of counterpart Chinese Application No. 201780050959.8, along with an English translation.

Sunburner, Toho Textile Co., Ltd. [online], retrieval date Dec. 7, 2017, Internet: <URL: http://www.tohotextile.co.jp/material/sunburner.html> [including an English translation].

The Extended European Search Report dated Apr. 3, 2020, of counterpart European Application No. 17858276.3.

* cited by examiner

FLAME-RESISTANT WOVEN FABRIC

TECHNICAL FIELD

This disclosure relates to a flame resistant woven fabric.

BACKGROUND

A method that has conventionally been adopted in applications requiring flame retardance is one in which an agent having a flame retardant effect is kneaded into a polyester-based, nylon-based, or cellulose-based fiber at a raw yarn stage, or one in which the agent is supplied into such a fiber in a post-process.

Generally flame retardants are halogen-based or phosphorus-based and, in recent years, substitution of phosphorus-based agents for halogen-based agents has been progressing due to environmental regulations. However, phosphorus-based agents are surpassed by conventional halogen-based agents in the flame retardant effect.

In this regard, there is a method of imparting higher flame retardance, in which method a polymer having high flame retardance is used in a composite. For example, there are known composites, including: a composite of a meta-aramid which is a flame retardant polymer of a carbonized type, a flame retardance-treated polyester, and a modacrylic fiber (JP 11-293542 A); a composite of a meta-aramid and PPS (JP 01-272836 A); and a composite of a flame resistant yarn and a flame retardance treated-polyester (JP 2005-334525 A).

However, conventional flame retardant abilities are based on 1) the LOI values specified in JIS and the flame retardancy standards specified in the Fire Service Law, and 2) the abilities exhibited under the conditions in which an ignition source and a heating time are standardized. Such abilities are not regarded as sufficient to prevent flame-spreading in a long time exposure to flame such as in an actual fire. Imparting a long time flame-spreading prevention effect requires a flame retardant material to be made sufficiently thick or the material to be composited with a noncombustible inorganic material and, accordingly, causes not only a problem that the texture is significantly impaired and the flexibility is made poor, but also a problem that the workability onto a curved surface is reduced.

According to the method described in JP '542, the composite has flexibility, a high LOI value in addition, and excellent flame retardance, but the meta-aramid is rapidly shrunk and hardened by an increase in temperature. Thus, the composite generates stress concentration locally, fails to maintain a textile form, and lacks the ability to block flame for a long time.

In addition, JP '836 discloses that forming a meta-aramid and PPS into a composite affords excellent chemical resistance and a high LOI value, but that evaluation is based on a yarn form, and the literature does not describe a textile form for blocking flame for a long time. In addition, a textile form made by using such a technology without any change is not regarded as having a sufficient ability to block flame for a long time.

Furthermore, JP '525 discloses a woven fabric of a flame resistant yarn and a flame retardant polyester. Although the fabric exhibits flame retardance because the warp is a flame retardant polyester, a long time contact with flame collapses the fabric structure, and accordingly the fabric lacks the ability to block flame.

It could therefore be helpful to provide a flame resistant woven fabric having high flame resistance.

SUMMARY

We thus provide:

A flame resistant woven fabric having a thickness of 0.08 mm or more in accordance with the method of JIS L 1096-A (2010) and consisting of warps and wefts, the warp and the weft each containing: a non-melting fiber A having a high-temperature shrinkage rate of 3% or less; and a thermoplastic fiber B having an LOI value of 25 or more in accordance with JIS K 7201-2 (2007) and having a melting point lower than the ignition temperature of the non-melting fiber A; wherein the warp and the weft each have a fracture elongation of more than 5%; and wherein, in the projection area of the weave repeat of the flame resistant woven fabric, the area ratio of the non-melting fiber A is 10% or more and the area ratio of the thermoplastic fiber B is 5% or more.

The flame resistant woven fabric preferably contains a fiber C other than the non-melting fiber A and the thermoplastic fiber B, wherein, in the projection area of the weave repeat of the flame resistant woven fabric, the area ratio of the fiber C is 20% or less.

The non-melting fiber A in the flame resistant woven fabric is preferably selected from the group consisting of a flame retardant fiber, a meta-aramid fiber, a glass fiber, and a mixture thereof.

The thermoplastic fiber B in the flame resistant woven fabric is preferably a fiber composed of a resin selected from the group consisting of polyphenylene sulfide, a flame retardant liquid crystal polyester, a flame retardant poly (alkylene terephthalate), a flame retardant poly(acrylonitrile-butadiene-styrene), a flame retardant polysulfone, a poly(ether-ether-ketone), a poly(ether-ketone-ketone), a polyether sulfone, a polyarylate, a polyphenyl sulfone, a polyether imide, a polyamide-imide, and a mixture thereof.

The flame resistant woven fabric has the above-mentioned structure and thus has high flame resistance.

REFERENCE SIGNS LIST

Figure 1:
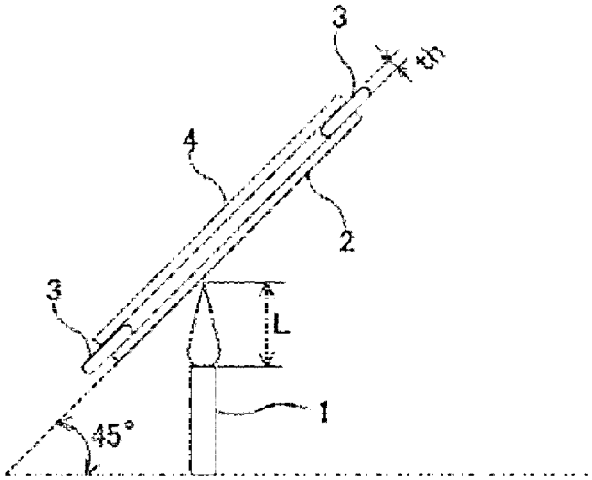
FIG. 1 is a schematic illustration showing a flammability test for assessment of flame resistance.

1 Micro Burner
2 Specimen
3 Spacer
4 Combustible Object
21 Longitudinal Length of Weave Repeat of Woven Fabric
22 Crosswise Length of Weave Repeat of Woven Fabric
D1 Diameter of Warp
D2 Diameter of Weft

DETAILED DESCRIPTION

Our fabrics will be described in detail below.

High-Temperature Shrinkage Rate

The high-temperature shrinkage rate herein is a value determined as follows. The fiber used to form the nonwoven fabric is left to stand under standard conditions (20° C., 65% relative humidity) for 12 hours. The initial length $L_0$ of the fiber is measured under a tension of 0.1 cN/dtex. Then, the fiber under no load is exposed to dry heat atmosphere at 290° C. for 30 minutes, and then sufficiently cooled under standard conditions (20° C., 65% relative humidity). The length $L_1$ of the fiber is measured under a tension of 0.1 cN/dtex. From $L_0$ and $L_1$, the high-temperature shrinkage rate is determined by the formula below:

$$\text{High-temperature Shrinkage Rate}=[(L_0-L_1)/L_0]\times 100\ (\%).$$

In the flame resistant woven fabric, the non-melting fiber A has a high-temperature shrinkage rate of 3% or less. When a flame approaches the fabric, the thermoplastic fiber is melted by the heat, and the molten thermoplastic fiber spreads over the surface of the non-melting fiber (the structural filler) like a thin film. Then, as the temperature of the fabric goes up, both types of fibers are eventually carbonized. When the high-temperature shrinkage rate of the non-melting fiber is more than 3%, the vicinity of the high-temperature portion in contact with flame is shrunk more easily and, in addition, a thermal stress generated between the high temperature portion and the low-temperature portion not in contact with flame causes a fracture in the fabric more easily, and accordingly the fabric cannot block flame for a long time. In this respect, it is preferable that the high-temperature shrinkage rate is lower and that the fracture elongation of the fabric-forming yarn is higher, but even without shrinkage, large elongation of the fabric by heat may collapse the fabric structure and cause flame to penetrate the collapsed portion. Accordingly, the high-temperature shrinkage rate is preferably −5% or more. Particularly preferably, the high-temperature shrinkage rate is from 0 to 2%.

LOI Value

The LOI value is the minimum volume percentage of oxygen in a gas mixture of nitrogen and oxygen required to sustain combustion of a material. A higher LOI value indicates better flame retardance. Thus, the LOI value of the thermoplastic fiber B in the flame resistant woven fabric is 25 or more in accordance with JIS K 7201-2 (2007). When the LOI value of the thermoplastic fiber B is less than 25, the thermoplastic fiber tends to be more combustible, makes it more difficult to extinguish the flame even with the flame source separated, and does not enable flame-spreading to be prevented. A higher LOI value is preferred, but the upper limit of LOI value of currently available materials is about 65.

Ignition Temperature

The ignition temperature is a spontaneous ignition temperature measured by the method based on JIS K 7193 (2010).

Melting Point

The melting point is a value measured by the method based on JIS K 7121 (2012). The melting point refers to the value of the melting peak temperature obtained by heating at 10° C./minute.

Fracture Elongation of Yarn

The fracture elongation of yarn refers to that which is measured by the method based on JIS L 1095 (2010). Specifically, the fracture elongation is an elongation at which the yarn is fractured in performing a tensile test in which an initial tension of 0.2 cN/dtex is applied and in which the test conditions including a specimen length of 200 mm between grips and a tension rate of 100% strain/minute are used. The test is performed 50 times, and the average value for the specimens excluding the ones that are fractured at the grip portions is adopted.

The warp and weft that form the flame resistant woven fabric have a fracture elongation of 5% or more. When at least one of the fracture elongation of the warp and the weft is less than 5%, the fabric tends to be fractured by thermal stress generated between the high-temperature portion in contact with flame and the low-temperature portion not in contact with flame and, as a result, the fabric is unable to block flame for a long time and is impossible to process under tension.

Non-Melting Fiber A

The non-melting fibers A herein refer to fibers that, when exposed to a flame, are not melted into a liquid but maintain the shape of the fibers. The non-melting fibers are preferably not liquefied nor ignited at a temperature of 700° C., more preferably not liquefied nor ignited at a temperature of 800° C. or more. Examples of non-melting fibers having the above-mentioned high-temperature shrinkage rate within the range specified herein include flame resistant fibers, meta-aramid fibers, and glass fibers. Flame resistant fibers are fibers produced by applying flame resistant treatment to raw fibers selected from acrylonitrile fibers, pitch fibers, cellulose fibers, phenol fibers and the like. The non-melting fibers may be of a single type or a combination of two or more types. Of the above exemplified fibers, more preferred ones are flame resistant fibers which have a lower high-temperature shrinkage rate and whose carbonization is promoted by the oxygen insulation effect of the film formed by the contact of the below-mentioned thermoplastic fiber B with flame, thereby further enhancing the heat resistance of the fiber at high temperatures. Of various types of flame resistant fibers, flame resistant yarns made from polyacrylonitrile fiber are more preferred because they have a small specific gravity, flexibility, and excellent flame retardancy. The acrylonitrile-based flame resistant fibers can be produced by heating and oxidizing acrylic fibers as a precursor in air at high temperature. Examples of commercially available acrylonitrile-based flame resistant fibers include flame resistant "PYRON" (registered trademark) fibers manufactured by Zoltek Corporation, which are used in the Examples and the Comparative Examples described later, and "Pyromex" (registered trademark) manufactured by Toho Tenax Co., Ltd. In general, meta-aramid fibers have a high high-temperature shrinkage rate and do not meet the high-temperature shrinkage rate specified herein. However, meta-aramid fibers can be made suitable by a treatment to reduce the high-temperature shrinking rate to fall within the range specified herein. Furthermore, glass fibers generally have a small fracture elongation and do not satisfy our range of fracture elongation, but can be preferably used as a spun yarn or a glass fiber that is composited with a different material, thus used as a fabric-forming yarn, and thereby made to have a fracture elongation.

In addition, non-melting fibers are preferably used singly or according to a method in which a non-melting fiber is composited with a different material, and the fibers may be either a filament form or a staple form. The fiber in staple form to be used for spinning preferably has a length of 30 to 60 mm, more preferably 38 to 51 mm. A fiber length of 38 to 51 mm makes it possible to form the fiber into a spun yarn in a general spinning process and makes it easy to mix-spin the fiber with a different material. In addition, the thickness of the single fiber of the non-melting fiber is not limited to a particular value, and the fineness of the single fiber is preferably 0.1 to 10 dtex in the light of passability in a spinning process.

Thermoplastic Fiber B

A thermoplastic fiber B has an LOI value of 25 or more as above-mentioned and has a melting point lower than the ignition temperature of the non-melting fiber A. When the LOI value of the thermoplastic fiber B is less than 25, the thermoplastic fiber cannot inhibit from combusting in the air, and makes it more difficult for the polymer to be carbonized. The thermoplastic fiber B having a melting point equal to or higher than the ignition temperature of the non-melting fiber A causes the molten polymer to volatilize before forming a film on the surface of the non-melting fibers A and between the fibers, and cannot be expected to have a flame resistant effect. The melting point of the thermoplastic fiber B is preferably not less than 200° C. lower, more preferably not less than 300° C. lower, than the ignition temperature of the non-melting fiber A. Specific examples include a fiber composed of a thermoplastic resin selected from the group consisting of polyphenylene sulfide, a flame retardant liquid crystal polyester, a flame retardant poly(alkylene terephthalate), a flame retardant poly(acrylonitrile-butadiene-styrene), a flame retardant polysulfone, a poly(ether-ether-ketone), a poly(ether-ketone-ketone), a polyether sulfone, a polyarylate, a polyphenyl sulfone, a polyether imide, a polyamide-imide, and a mixture thereof. The thermoplastic fibers may be of a single type or a combination of two or more types. Of the above-mentioned fibers, polyphenylene sulfide fibers (hereinafter also called PPS fibers) are most preferred in the light of their high LOI value, the melting point range, and easy availability. In addition, even if the polymer does not have an LOI value in our range, the polymer can be used in a preferred manner if the polymer is treated with a flame retardant, thereby allowing the LOI value obtained after the treatment to be in our range. The flame retardant is not limited to a particular one, and is preferably a phosphorus-based or sulfur-based flame retardant that expresses a mechanism in which to generate a phosphoric acid or a sulfuric acid in thermal decomposition and dehydrate/carbonize the polymer base material.

In addition, the above-mentioned thermoplastic resin as the thermoplastic fiber B is used singly or according to a method in which a thermoplastic resin is composited with a different material, and the thermoplastic fiber may be either a filament form or a staple form. The fiber in staple form to be used for spinning preferably has a length of 30 to 60 mm, more preferably 38 to 51 mm. A fiber length of 38 to 51 mm makes it possible to form the fiber into a spun yarn in a general spinning process and makes it easy to mix-spin the fiber with a different material. In addition, the thickness of the single fiber of the thermoplastic fiber B is not limited to a particular value, and the fineness of the single fiber is preferably 0.1 to 10 dtex in the light of passability in a spinning process.

The total fineness of the fiber used in filament form and the yarn count used for the fiber to be made into a spun yarn are not limited to particular values as long as the values satisfy our ranges, and may be suitably selected, taking a desired thickness into consideration.

PPS fibers, which are preferred, are synthetic fibers made from a polymer containing structural units of the formula —($C_6H_4$—S)— as primary structural units. Representative examples of the PPS polymer include polyphenylene sulfide, polyphenylene sulfide sulfone, polyphenylene sulfide ketone, random copolymers and block copolymers thereof, mixtures thereof and the like. A particularly preferred and desirable PPS polymer is polyphenylene sulfide containing, preferably 90 mol % or more of, p-phenylene units of the formula —($C_6H_4$—S)— as primary structural units. In terms of mass %, a desirable polyphenylene sulfide contains, 80% by mass or more of, preferably 90% by mass or more of, the p-phenylene units.

In addition, PPS fibers are preferably used singly or according to a method in which a PPS fiber is composited with a different material, and the fibers may be either a filament form or a staple form. The fiber in staple form to be used for spinning preferably has a length of 30 to 60 mm, more preferably 38 to 51 mm. A fiber length of 38 to 51 mm makes it possible to form the fiber into a spun yarn in a general spinning process and makes it easy to mix-spin the fiber with a different material. In addition, the thickness of the single fiber of the PPS fiber is not limited to a particular value, and the fineness of the single fiber is preferably 0.1 to 10 dtex in the light of passability in a spinning process.

The PPS fibers are preferably produced by melting a polymer containing the phenylene sulfide structural units at a temperature equal to or greater than the melting point of the polymer, and spinning the molten polymer from a spinneret into fibers. The spun fibers are undrawn PPS fibers, which are not yet subjected to a drawing process. Most of the undrawn PPS fiber has an amorphous structure, and has a high fracture elongation. On the other hand, such undrawn fibers have the disadvantage of poor dimensional stability under heat. To overcome this disadvantage, the spun fibers are subjected to a heat-drawing process that orients the fibers and increases the strength and the thermal dimensional stability of the fibers. Such a drawn yarn is commercially available in various types. Commercially available drawn PPS fibers include, for example, "TORCON" (registered trademark) (Toray Industries, Inc.) and "PROCON" (registered trademark) (Toyobo Co., Ltd.).

The undrawn PPS fiber can be used in combination with a drawn yarn to the extent that our ranges are satisfied. Needless to say, instead of PPS fibers, other types of drawn and undrawn yarns that satisfy the requirements disclosed herein can be used in combination. Fiber C other than Non-melting Fiber A and Thermoplastic fiber B A fiber C may be added to the fabric, in addition to the non-melting fiber A and the thermoplastic fibers B, to impart a particular characteristic. For example, a vinylon fiber, a polyester fiber other than the thermoplastic fiber B, a nylon fiber, and the like may be used to enhance the hygroscopicity and water absorbability of the knitted fabric. In addition, a spandex fiber may be used to impart stretchability. Examples of spandex fibers include "LYCRA" (registered trademark) from Toray Opelontex Co., Ltd., "ROICA" (registered trademark) from Asahi Kasei Corporation, "CREORA" (registered trademark) from Hyosung Corporation, and the like. The amount of the fiber C is not limited to a particular value as long as the desired effects are not impaired, and the area ratio of the fiber C other than the non-melting fiber A and the thermoplastic fiber B is preferably 20% or less, more preferably 10% or less, in the projection area of the weave repeat of the flame resistant woven fabric.

The woven fabric has a thickness of 0.08 mm or more, as measured by the method based on JIS L 1096 (2010). The woven fabric preferably has a thickness of 0.3 mm or more. The woven fabric having a thickness of less than 0.08 mm cannot obtain sufficient flame resistance.

The density of the woven fabric is not limited to a particular value, and suitably selected in accordance with the required flame resistant performance. Although a smaller density increases the air layer and thereby enhances heat insulation properties, a density in a range which affords easy handling and a target flame resistance is acceptable.

The form of a yarn used for the woven fabric may be either a spun yarn or a filament yarn.

When a spun yarn is used, the non-melting fiber A and the thermoplastic fiber B may each be used as a spun yarn, or the non-melting fiber A and the thermoplastic fiber B may be mix-spun at a predetermined ratio in a range. To obtain sufficient entanglement between pieces of the fiber, the number of crimps of the fiber is preferably 7 crimps/2.54 cm or more, but too large a number of crimps reduces passability in a process in which slivers are made using a carding machine and, accordingly, the number of crimps is preferably less than 30 crimps/2.54 cm. In mix-spinning the non-melting fiber A and the thermoplastic fiber B, using both in the form of short fiber having the same length affords a more even spun yarn and hence is preferable. In this regard, the length does not have to be strictly the same, and there may be a difference of about ±5% from the length of the non-melting fiber A. From this viewpoint, the fiber length of the non-melting fiber and the fiber length of the melting fiber are preferably 30 to 60 mm, more preferably 38 to 51 mm. A mix-spun yarn is obtained, for example, by carrying out processes in which pieces of fiber are mixed evenly using an opening device and then made into slivers using a carding machine, and the slivers are drawn using a drawing frame and undergo roving and spinning. A plurality of pieces of the obtained spun yarn may be intertwisted.

When a filament is used, a false twisted yarn of each of the non-melting fiber A and the thermoplastic fiber B or a composite of the non-melting fiber A and the thermoplastic fiber B can be used wherein the composite is made using a method such as air filament combining or composite false twisting.

The woven fabric is weaved using a spun yarn or a filament yarn obtained as above-mentioned and using an air jet loom, a water jet loom, a rapier loom, a projectile loom, a shuttle loom, or the like. In a warp preparation process, the warp may undergo sizing or no sizing, and when a yarn containing a flame resistant yarn fiber is used, sizing is preferably carried out to inhibit fuzzing in weaving the flame resistant yarn. The textile weave may be selected, in accordance with the texture and design, from a plain weave, a twill weave, a satin weave, and a derivative weave thereof. Furthermore, the textile weave may be a multiple weave such as a double weave.

Area Ratio

The fabric-forming yarn and the weaving structure are such that, in the projection area of the weave repeat of the woven fabric, the area ratio of the non-melting fiber A is 10% or more and the area ratio of the thermoplastic fiber B is 5% or more. The non-melting fiber A having an area ratio of less than 10% results in having an insufficient function as a structural filler. The non-melting fiber A preferably has an area ratio of 15% or more. The thermoplastic fiber B having an area ratio of less than 5% does not allow the thermoplastic fiber to sufficiently spread in the form of a film among the non-melting fibers which serve as a structural filler. The thermoplastic fiber B preferably has an area ratio of 10% or more.

Below, the method of calculating the area ratio will be described.

The weave repeat of a woven fabric refers to the minimum repeating unit forming the woven fabric. Assuming that the cotton count of a fabric-forming yarn is $N_e$ and that the cross-section of the yarn is circular, the diameter D (cm) of the yarn is calculated using the Equation below when the yarn has a density of ρ (g/cm$^3$). The density p of the fiber is measured by the method based on ASTM D4018-11.

$$D=0.08673/\{(N_e\times\rho)^{1/2}\}$$

When the fabric-forming yarn is a composite of two kinds of fibers: a fiber α and a fiber β, the density ρ' of the yarn is calculated using the Equation below, assuming that the respective fiber densities are $\rho_\alpha$ and $\rho_\beta$ and that the respective weight mixing ratios are $Wt_\alpha$ and $Wt_\beta$:

$$\rho'=(\rho_\alpha\times Wt_\alpha)+(\rho_\beta\times Wt_\beta)$$

wherein $Wt_\alpha+Wt_\beta=1$.

Figure 2:
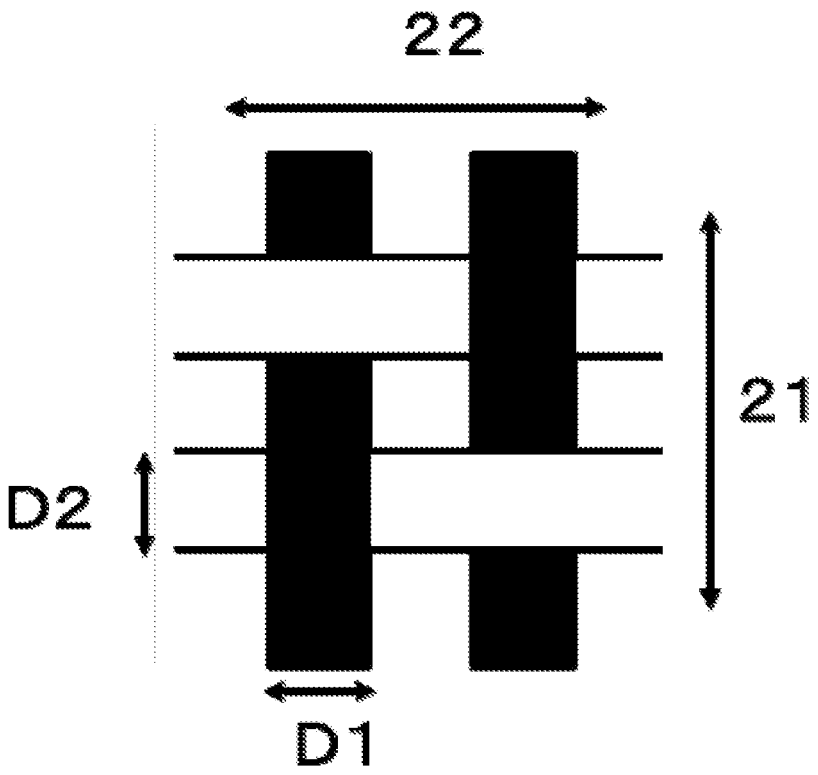
FIG. 2 is a conceptual illustration showing the weave repeat of a plain weave fabric and depicted for the purpose of explaining the projection area of the weave repeat of the woven fabric and the projection area of each fiber.

For example, a plain weave is expressed with two each of warps and wefts. FIG. 2 is a conceptual illustration showing the weave repeat of a plain weave fabric and depicted for the purpose of explaining the projection area of the weave repeat of the woven fabric and the projection area of each fiber. Assuming that the yarn density of the warp is $n_1$ (warps/inch (2.54 cm)) and that the yarn density of the weft is $n_2$ (wefts/inch (2.54 cm)), the longitudinal length 21 and the crosswise length 22 of the weave repeat of the woven fabric is $(2.54\times2)/n_2$ (cm) and $(2.54\times2)/n_1$ (cm) respectively, and the projection area S of the weave repeat of the woven fabric is calculated using the Equation below:

$$S=\{(2.54\times2)/n_2\}\times\{(2.54\times2)/n_1\}(\text{cm}^2).$$

Assuming that the cross-section of the fabric-forming yarn is circular and that weaving does not deform the yarn, the projection diameter of the fabric-forming yarn is D. Assuming that the warp diameter and the weft diameter are $D_1$ and $D_2$ respectively, the areas $S_1$ and $S_2$ of the warp and the weft respectively in the weave repeat of the woven fabric are calculated using the Equations below:

$$S_1=2\times[\{(2.54\times2\times D_1)/n_2\}-(D_1\times D_2)]$$

$$S_2=2\times[\{(2.54\times2\times D_2)/n_1\}-(D_1\times D_2)].$$

The fabric-forming yarn is composed of two kinds of fibers: the fiber α and the fiber β, and the respective weight mixing ratios are $Wt_\alpha$ and $Wt_\beta$. Accordingly, the volumes $V_\alpha$ and $V_\beta$ of the fiber α and the fiber β respectively contained in the fabric-forming yarn satisfy the relationship below:

$$(\rho_\alpha\times V_\alpha):(\rho_\beta\times V_\beta)=Wt_\alpha:Wt_\beta.$$

That is, $$(V_\alpha/V_\beta)=(\rho_\beta\times Wt_\alpha)/(\rho_\alpha\times Wt_\beta).$$

No matter what the form in which the two kinds of fibers are composited may be, the thermoplastic fiber B of the flame resistant woven fabric brought into contact with flame is melted and covers the surface of the woven fabric. Accordingly, the area ratios ($S_\alpha/S_\beta$) of the respective fibers in the surface of the fabric-forming yarn are regarded as equal to the volume ratios ($V_\alpha/V_\beta$) of the respective fibers, and the projection area of each fiber is calculated by multiplying the projection area of the fabric-forming yarn by the area ratio of the fiber.

Assuming that, when the weight mixing ratios of the fiber α and the fiber β in the warp are $Wt_{\alpha1}$ and $Wt_{\beta1}$ respectively and the weight mixing ratios of the fiber α and the fiber β in the weft are $Wt_{\alpha2}$ and $Wt_{\beta2}$ respectively, the area ratios of the fiber α and the fiber β in the warp are ($S_{\alpha1}/S_{\beta1}$) and the area ratios of the fiber α and the fiber β in the weft are ($S_{\alpha2}/S_{\beta2}$), the projection areas $S_\alpha$ and $S_\beta$ of the fiber α and the fiber β respectively in the weave repeat of the woven fabric are calculated using the Equations below:

$$S_\alpha=S_1\times\{S_{\alpha1}/(S_{\alpha1}+S_{\beta1})\}+S_2\times\{S_{\alpha2}/(S_{\alpha2}+S_{\beta2})\}$$

$$S_\beta = S_1 \times \{S_{\beta 1}/(S_{\alpha 1}+S_{\beta 1})\} + S_2 \times \{S_{\beta 2}/(S_{\alpha 2}+S_{\beta 2})\}.$$

The projection area of the weave repeat of the woven fabric is S and, accordingly, the area ratio $P_\alpha$ of the fiber α and the area ratio $P_\beta$ of the fiber β are each calculated using the Equations below:

$$P_\alpha(\%) = (S_\alpha/S) \times 100$$

$$P_\beta(\%) = (S_\beta/S) \times 100.$$

Also, when the fabric-forming yarn contains three or more kinds of fibers, calculations can be made from the weight mixing ratios of the respective fibers using the same procedures as above-mentioned. Calculations can also be made for a weave other than a plain weave in accordance with the above-mentioned concept. In a multiple weave such as a double weave, the projection area of the face exposed to flame is used for calculation.

After weaving, the woven fabric is subjected to desizing and scouring by a usual method, and then may be heat-set to a predetermined width and density using a tenter or may be used as a gray fabric. The setting temperature is preferably a temperature at which an effect of suppressing the high-temperature shrinkage rate is obtained, and is preferably 160 to 240° C., more preferably 190 to 230° C.

At the same time as heat setting or in a different process after heat setting, a resin treatment may be carried out for the purposes of improving abrasion resistance or texture to the extent that the desired effects are not impaired. The resin treatment can be selected, depending on the kind of a resin to be used, from: a pad dry cure method in which a woven fabric is dipped in a resin vessel, then squeezed using a padder, dried, and allowed to have the adhered resin; or a pad-steam method in which a resin is allowed to react and adhered to a fabric in a steam vessel.

The thus obtained flame resistant woven fabric has excellent flame resistance and an excellent flame-spreading preventing effect and, accordingly, is suitably used for clothing materials, wall materials, floor materials, ceiling materials, coating materials, and the like which require flame retardance, and, in particular, can be suitably used for fireproof protective clothing and coating materials for preventing flame-spreading of urethane sheet materials in automobiles, aircrafts, and the like, and suitably used to prevent flame-spreading of bed mattresses.

EXAMPLES

Our fabrics will be specifically described with reference to Examples. However, this disclosure is not limited to the Examples. Various alterations and modifications are possible within the technical scope of the disclosure. The various properties evaluated in the Examples were measured by the following methods.

Weight

The mass per unit area was measured in accordance with JIS L 1096 (2010) and expressed in terms of the mass per $m^2$ ($g/m^2$).

Thickness

The thickness was measured in accordance with JIS L 1096 (2010).

LOI Value

The LOI value was measured in accordance with JIS K 7201-2 (2007).

Assessment of Flame Resistance

The flame resistance was assessed by subjecting a specimen to a flame by a modified method based on the A-1 method (the 45° micro burner method) in JIS L 1091 (Testing methods for flammability of textiles, 1999), as follows. As shown in FIG. 1, a micro burner (1) with a flame of 45 mm in length (L) was placed vertically, then a specimen (2) was held at an angle of 45° relative to the horizontal plane, and a combustible object (4) was mounted above the specimen (2) via spacers (3) of 2 mm in thickness (th) inserted between the specimen and the combustible object. The specimen was subjected to burning to assess the flame resistance. As the combustible object (4), a qualitative filter paper, grade 2 (1002) available from GE Healthcare Japan Corporation was used. Before use, the combustible object (4) was left to stand under standard conditions for 24 hours to make the moisture content uniform throughout the object. In the assessment, the time from ignition of the micro burner (1) to the spread of flame to the combustible object (4) was measured in seconds. In this regard, a specimen that has allowed the combustible object 4 to be ignited within three minutes after the specimen came in contact with flame is regarded as "having no flame resistance" and unacceptable. A specimen that does not allow the combustible object 4 to be ignited even after the specimen is exposed to flame for three minutes or more is regarded as "having flame resistance." The longer the flame resisting time is, the better it is. The time from 3 minutes or more to less than 20 minutes is regarded as good, and the time of 20 minutes or more is regarded as excellent.

The terms used in the following Examples and Comparative Examples will be described below.

Drawn Yarn of PPS Fiber

"TORCON" (registered trademark), catalog number S371 (made by Toray Industries, Inc.) having a single fiber fineness of 2.2 dtex (14 μm in diameter) and a cut length of 51 mm was used as a drawn PPS fiber. This PPS fiber had an LOI value of 34 and a melting point of 284° C.

Drawn Yarn of Polyester Fiber

"TETORON" (registered trademark), catalog number T9615 (made by Toray Industries, Inc.), which is a polyethylene terephthalate fiber having a single fiber fineness of 2.2 dtex (14 μm in diameter), was cut into a length of 51 mm and used as a drawn polyester fiber. This polyester fiber had an LOI value of 22 and a melting point of 256° C.

Flame Resistant Yarn

A 1.7 dtex flame resistant fiber made of "PYRON" (registered trademark) made by Zoltek Corporation was cut into a length of 51 mm and used. The "PYRON" (registered trademark) had a high-temperature shrinkage rate of 1.6%. When the fiber was heated by the method based on JIS K 7193 (2010), there was no ignition recognized at 800° C., and the ignition temperature was 800° C. or more.

Example 1

Spinning

The drawn yarn of PPS fiber and the flame resistant yarn were mixed using an opening device, then further mixed using a mixing and scutching machine, and then made into a sliver through a carding machine. The obtained sliver had a weight of 310 grains/6 yards (1 grain=1/7000 pounds) (20.09 g/5.46 m). Then, the sliver was drawn using a drawing frame set to an eight-fold total draft, and made into a 290 grains/6 yard (18.79 g/5.46 m) sliver. Then, the sliver was twisted to 0.55 T/2.54 cm using a flyer frame and drawn 7.4-fold to obtain a roving of 250 grains/6 yard (16.20 g/5.46 m). Then, the roving was twisted to 16.4 T/2.54 cm using a fine spinning frame, drawn to a 30-fold total draft, and twisted to obtain a spun yarn whose cotton count is No. 30. The obtained spun yarn was given a final twist to 64.7 T/2.54 cm using a two-for-one twister to obtain a No. 30 two folded yarn. The weight mixing ratio of the drawn yarn of PPS fiber to the flame resistant yarn in the spun yarn is 60 to 40. The spun yarn had a tensile strength of 2.2 cN/dtex and a tensile elongation of 18%.

Weaving

The obtained spun yarn was weaved using a rapier loom into a plain weave having 50 warps/inch (2.54 cm) and 50 wefts/inch (2.54 cm).

Scouring and Heat-Setting

The plain weave was scoured in an 80° C. warm water containing a surfactant for 20 minutes, then dried using a tenter at 130° C. and, further, heat-set using a tenter at 230° C. After the heat-setting, the yarn density of the woven fabric was 52 warps/inch (2.54 cm) and 51 wefts/inch (2.54 cm). The woven fabric had a thickness of 0.570 mm. According to measurement of the strength and elongation of the raveled yarn, the tensile strength was 1.7 cN/dtex, and the tensile elongation was 16%.

Assessment of Flame Resistance

In assessment of flame resistance of the woven fabric of this Example, no spread of flame to the combustible object was observed during 30-minutes exposure to the flame, indicating that the woven fabric had sufficient flame resistance.

Example 2

A woven fabric having 22 warps/inch (2.54 cm) and 21 wefts/inch (2.54 cm) was obtained by weaving the spun yarn described in Example 1 at 20 warps/inch (2.54 cm) and 20 wefts/inch (2.54 cm) and carrying out scouring and heat-setting under the same conditions as in Example 1. The woven fabric had a thickness of 0.432 mm. According to measurement of the strength and elongation of the raveled yarn, the tensile strength was 1.8 cN/dtex, and the tensile elongation was 18%. In assessment of flame resistance of the woven fabric of this Example, no spread of flame to the combustible object was observed during 10-minutes exposure to the flame, indicating that the woven fabric had sufficient flame resistance.

Example 3

This Example was carried out under the same conditions as in Example 1 except that the mixing ratio of the PPS to the flame resistant yarn in the spun yarn was 20 to 80. The obtained spun yarn had a tensile strength of 1.9 cN/dtex and a tensile elongation of 15%. After the scouring and heat-setting, the yarn density of the woven fabric was 51 warps/inch (2.54 cm) and 51 wefts/inch (2.54 cm). The woven fabric had a thickness of 0.640 mm. According to measurement of the strength and elongation of the raveled yarn, the tensile strength was 1.5 cN/dtex, and the tensile elongation was 12%. In assessment of flame resistance of the woven fabric of this Example, no spread of flame to the combustible object was observed during 30-minutes exposure to the flame, indicating that the woven fabric had sufficient flame resistance.

Example 4

This Example was carried out under the same conditions as in Example 1 except that the mixing ratio of the PPS to the flame resistant yarn in the spun yarn was to 80 to 20. The obtained spun yarn had a tensile strength of 2.3 cN/dtex and a tensile elongation of 20%. After the scouring and heat-setting, the yarn density of the woven fabric was 52 warps/inch (2.54 cm) and 51 wefts/inch (2.54 cm). The woven fabric had a thickness of 0.560 mm. According to measurement of the strength and elongation of the raveled yarn, the tensile strength was 2.0 cN/dtex, and the tensile elongation was 16%. In assessment of flame resistance of the woven fabric of this Example, no spread of flame to the combustible object was observed during 20-minutes exposure to the flame, indicating that the woven fabric had sufficient flame resistance.

Example 5

This Example was carried out under the same conditions as in Example 1 except that, in addition to the PPS and the flame resistant yarn, a drawn yarn of polyester fiber was mixed in the spun yarn and that the mixing ratio was 60 to 20 to 20. The obtained spun yarn had a tensile strength of 2.2 cN/dtex and a tensile elongation of 21%. After the scouring and heat-setting, the yarn density of the woven fabric was 51 warps/inch (2.54 cm) and 52 wefts/inch (2.54 cm). The woven fabric had a thickness of 0.580 mm. According to measurement of the strength and elongation of the raveled yarn, the tensile strength was 1.8 cN/dtex, and the tensile elongation was 18%. In assessment of flame resistance of the woven fabric of this Example, no spread of flame to the combustible object was observed during 20-minutes exposure to the flame, indicating that the woven fabric had sufficient flame resistance.

Example 6

In the same manner as in Example 1, a spun yarn whose yarn count was No. 30 was made using a drawn yarn of polyester fiber, and two pieces of the spun yarn were intertwisted into a two folded yarn. A woven fabric was made, wherein the warp was a mix-spun yarn such as in Example 1 of a drawn yarn of PPS fiber and a flame resistant yarn at a weight mixing ratio of 60 to 40 and the weft was a mix-spun yarn of a spun yarn of a drawn yarn of polyester fiber, a drawn yarn of PPS fiber, and a flame resistant yarn, and wherein the warps and the wefts are alternately woven one by one. The woven fabric was scoured and heat-set using the same procedure as in Example 1. After the heat-setting, the yarn density of the woven fabric was 50 warps/inch (2.54 cm) and 49 wefts/inch (2.54 cm). The woven fabric had a thickness of 0.510 mm. According to measurement of the strength and elongation of the raveled yarn, the tensile strength was 1.8 cN/dtex, and the tensile elongation was 17%. In assessment of flame resistance of the woven fabric of this Example, no spread of flame to the combustible object was observed during 15-minutes exposure to the flame, indicating that the woven fabric had sufficient flame resistance.

Example 7

This Example was carried out under the same conditions as in Example 1 except that, in addition to the PPS and the flame resistant yarn, a drawn yarn of polyester fiber and rayon DFG from Daiwabo Rayon Co., Ltd. were mixed in the spun yarn and that the mixing ratio was 20 to 20 to 30 to 30 as the PPS to the flame resistant yarn to the polyester to the flame retardant rayon. The obtained spun yarn had a tensile strength of 2.2 cN/dtex and a tensile elongation of 20%. After the scouring and heat-setting, the yarn density of the woven fabric was 50 warps/inch (2.54 cm) and 50 wefts/inch (2.54 cm). The woven fabric had a thickness of 0.570 mm. According to measurement of the strength and elongation of the raveled yarn, the tensile strength was 1.6 cN/dtex, and the tensile elongation was 15%. In assessment of flame resistance of the woven fabric of this Example, no spread of flame to the combustible object was observed during 15-minutes exposure to the flame, indicating that the woven fabric had sufficient flame resistance.

Example 8

A woven fabric having 50 warps/inch (2.54 cm) and 50 wefts/inch (2.54 cm) was obtained by weaving the spun yarn described in Example 1 into a 2/1 twill weave at 50 warps/inch (2.54 cm) and 50 wefts/inch (2.54 cm) and carrying out scouring and heat-setting under the same conditions as in Example 1. The woven fabric had a thickness of 0.610 mm. According to measurement of the strength and elongation of the raveled yarn, the tensile strength was 1.9 cN/dtex, and the tensile elongation was 18%. In assessment of flame resistance of the woven fabric of this Example, no spread of flame to the combustible object was observed during 30-minutes exposure to the flame, indicating that the woven fabric had sufficient flame resistance.

Comparative Example 1

In the same manner as in Example 1, a spun yarn whose yarn count was No. 30 and in which the mixing ratio of PPS to a flame resistant yarn was 90 to 10 was made. The obtained spun yarn had a tensile strength of 2.3 cN/dtex and a tensile elongation of 21%. Two piece of the spun yarn were intertwisted to obtain a two folded yarn. A woven fabric having 51 warps/inch (2.54 cm) and 51 wefts/inch (2.54 cm) was obtained by weaving the yarn at 50 warps/inch (2.54 cm) and 50 wefts/inch (2.54 cm) and carrying out scouring and heat-setting under the same conditions as in Example 1. The woven fabric had a thickness of 0.560 mm. According to measurement of the strength and elongation of the raveled yarn, the tensile strength was 2.0 cN/dtex, and the tensile elongation was 17%. When the flame resistance of this woven fabric was assessed, the area ratio of the flame resistant yarn was too small, the PPS failed to form a coating between pieces of the flame resistant yarn while the woven fabric was in contact with flame. The flame penetrated the woven fabric in two minutes, and ignited the combustible object.

Comparative Example 2

In the same manner as in Example 1, a spun yarn whose yarn count was No. 30 and in which the mixing ratio of PPS to a flame resistant yarn was 5 to 95 was made. The obtained spun yarn had a tensile strength of 1.7 cN/dtex and a tensile elongation of 12%. Two pieces of the spun yarn were intertwisted to obtain a two folded yarn. A woven fabric having 51 warps/inch (2.54 cm) and 50 wefts/inch (2.54 cm) was obtained by weaving the yarn at 50 warps/inch (2.54 cm) and 50 wefts/inch (2.54 cm) and carrying out scouring and heat-setting under the same conditions as in Example 1. The woven fabric had a thickness of 0.590 mm. According to measurement of the strength and elongation of the raveled yarn, the tensile strength was 1.3 cN/dtex, and the tensile elongation was 12%. When the flame resistance of this woven fabric was assessed, the area ratio of the PPS was too small and thus the PPS failed to form a sufficient coating between pieces of the flame resistant yarn. Contact with flame gradually made the flame resistant yarn thinner and ignited the combustible object 2 minutes and 30 seconds after the contact with flame.

Comparative Example 3

A woven fabric having 15 warps/inch (2.54 cm) and 16 wefts/inch (2.54 cm) was obtained by weaving the spun yarn described in Example 1 at 15 warps/inch (2.54 cm) and 15 wefts/inch (2.54 cm) and carrying out scouring and heat-setting under the same conditions as in Example 1. The woven fabric had a thickness of 0.405 mm. According to measurement of the strength and elongation of the raveled yarn, the tensile strength was 1.8 cN/dtex, and the tensile elongation was 18%. When the flame resistance of this woven fabric was assessed, the area ratio of the flame resistant yarn was too small, the PPS failed to form a coating between pieces of the flame resistant yarn when the fabric was brought into contact with flame. The flame penetrated the woven fabric 1 minute and 30 seconds later, and ignited the combustible object.

Comparative Example 4

This Example was carried out under the same conditions as in Example 1 except that, in addition to the PPS and the flame resistant yarn, a drawn yarn of polyester fiber was mixed in the spun yarn and that the mixing ratio was 45 to 15 to 40. The obtained spun yarn had a tensile strength of 2.1 cN/dtex and a tensile elongation of 18%. After the scouring and heat-setting, the yarn density of the woven fabric was 51 warps/inch (2.54 cm) and 50 wefts/inch (2.54 cm). The woven fabric had a thickness of 0.530 mm. According to measurement of the strength and elongation of the raveled yarn, the tensile strength was 1.9 cN/dtex, and the tensile elongation was 16%. When the flame resistance of this woven fabric was assessed, the area ratio of the flame resistant yarn was too small, and accordingly the woven fabric was significantly shrunk when brought into contact with flame. In addition, the drawn yarn of molten polyester fiber failed to become a sufficient coating, and the flame penetrated the fabric 1 minute and 30 seconds later, and ignited the combustible object.

The following Tables 1 and 2 show the area ratios of the non-melting fibers A in Examples 1 to 6 and Comparative Examples 1 to 4, the area ratios of the thermoplastic fibers B having a melting point lower than the ignition temperature of the non-melting fiber A, the area ratios of the other fibers C, the thicknesses of the woven fabrics, and the flame resistance assessment results.

TABLE 1

| | | Example 1 | Example 2 | Example 3 | Example 4 | Example 5 | Example 6 | Example 7 | Example 8 |
|---|---|---|---|---|---|---|---|---|---|
| Yarn Components of Woven | Warp | PPS60%/ Flame Resistant | PPS60%/ Flame Resistant | PPS20%/ Flame Resistant | PPS80%/ Flame Resistant | PPS60%/ Flame Resistant | PPS60%/ Flame Resistant | PPS35%/ Flame Resistant | PPS60%/ Flame Resistant |

TABLE 1-continued

| | | Example 1 | Example 2 | Example 3 | Example 4 | Example 5 | Example 6 | Example 7 | Example 8 |
|---|---|---|---|---|---|---|---|---|---|
| Fabric | | Yarn 40% 30/2 s Spun Yarn | Yarn 40% 30/2 s Spun Yarn | Yarn 80% 30/2 s Spun Yarn | Yarn 20% 30/2 s Spun Yarn | Yarn 20%/ Polyester 20% 30/2 s Spun Yarn | Yarn 40% 30/2 s Spun Yarn | Yarn 30%/ Polyester 20%/ Flame Resistant Rayon 15% 30/2 s Spun Yarn | Yarn 40% 30/2 s Spun Yarn |
| | Weft | PPS60%/ Flame Resistant Yarn 40% 30/2 s Spun Yarn | PPS60%/ Flame Resistant Yarn 40% 30/2 s Spun Yarn | PPS20%/ Flame Resistant Yarn 80% 30/2 s Spun Yarn | PPS80%/ Flame Resistant Yarn 20% 30/2 s Spun Yarn | PPS60%/ Flame Resistant Yarn 20%/ Polyester 20% 30/2 Spun Yarn | PPS60%/ Flame Resistant Yarn 40% 30/2 s Spun Yarn and Polyester 100% 30/2 s Spun Yarn | PPS35%/ Flame Resistant Yarn 30%/ Polyester 20%/ Flame Resistant Rayon 15% 30/2 s Spun Yarn | PPS60%/ Flame Resistant Yarn 40% 30/2 s Spun Yarn |
| Woven Fabric Design | Textile Weave | Plain Weave | Plain Weave | Plain Weave | Plain Weave | Plain Weave | Plain Weave (A Weft Yarn inwoven alternately) | Plain Weave | 2/1 Twill Fabric |
| | Warp Density (Yarns/inch(2.54 cm)) | 52 | 22 | 51 | 52 | 51 | 50 | 50 | 50 |
| | Weft Density (Yarns/inch(2.54 cm)) | 51 | 21 | 51 | 51 | 52 | 49 | 50 | 50 |
| | Non-melting Fiber A Area Ratio (%) | 24 | 12 | 50 | 12 | 15 | 18 | 17 | 22 |
| | Thermoplastic Fiber B Area Ratio (%) | 37 | 18 | 13 | 51 | 47 | 28 | 19 | 33 |
| | Other Fiber C Area Ratio (%) | 0 | 0 | 0 | 0 | 15 | 9 | 20 | 0 |
| | Thickness (mm) | 0.570 | 0.432 | 0.640 | 0.560 | 0.580 | 0.510 | 0.570 | 0.610 |
| Performance | Flame Blocking Property | Excellent 30 min | Good 10 min | Excellent 30 min | Excellent 20 min | Excellent 20 min | Good 15 min | Good 15 min | Excellent 30 min |

TABLE 2

| | | Comparative Example 1 | Comparative Example 2 | Comparative Example 3 | Comparative Example 4 |
|---|---|---|---|---|---|
| Yarn Components of Woven Fabric | Warp | PPS90%/ Flame Resistant Yarn 10% 30/2 s Spun Yarn | PPS5%/ Flame Resistant Yarn 95% 30/2 s Spun Yarn | PPS60%/ Flame Resistant Yarn 40% 30/2 s Spun Yarn | PPS40%/ Flame Resistant Yarn 20%/ Polyester 40% 30/2 s Spun Yarn |
| | Weft | PPS90%/ Flame Resistant Yarn 10% 30/2 s Spun Yarn | PPS5%/ Flame Resistant Yarn 95% 30/2 s Spun Yarn | PPS60%/ Flame Resistant Yarn 40% 30/2 s Spun Yarn | PPS45%/ Flame Resistant Yarn 15%/ Polyester 40% 30/2 s Spun Yarn |
| Woven Fabric Design | Textile Weave | Plain Weave | Plain Weave | Plain Weave | Plain Weave |
| | Warp Density (Yarns/inch (2.54 cm)) | 51 | 51 | 15 | 51 |
| | Weft Density (Yarns/inch (2.54 cm)) | 51 | 50 | 16 | 50 |
| | Thermoplastic Fiber B Area Ratio (%) | 56 | 3 | 13 | 28 |
| | Other Fiber C Area Ratio (%) | 0 | 0 | 0 | 25 |
| | Thickness (mm) | 0.560 | 0.590 | 0.405 | 0.530 |
| Performance | Flame Blocking Property | Bad 2 min | Bad 2 min 30 sec | Bad 1 min 30 sec | Bad 1 min 30 sec |

INDUSTRIAL APPLICABILITY

Our fabrics are effective to prevent flame-spreading and, accordingly, are suitably used for clothing materials, wall materials, floor materials, ceiling materials, coating materials and the like requiring flame retardance and, in particular, suitably used for fireproof protective clothing and coating materials to prevent flame-spreading of urethane sheet materials in automobiles, aircrafts and the like, and used to prevent flame-spreading of bed mattresses.

The invention claimed is:

1. A flame resistant woven fabric having a thickness of 0.08 mm or more determined in accordance with JIS L 1096-A (2010) and consisting of warps and wefts, each comprising: a non-melting fiber A having a high-temperature shrinkage rate of 3% or less; and a thermoplastic fiber B having an LOI value of 25 or more determined in accordance with JIS K 7201-2 (2007) and having a melting point lower than an ignition temperature of said non-melting fiber A; wherein 1) said warp and said weft each have a fracture elongation of more than 5%; 2) in a projection area of a weave repeat of said flame resistant woven fabric, an area ratio of said non-melting fiber A is 10% or more and an area ratio of said thermoplastic fiber B is 5% or more, and 3) said non-melting fiber A is a flame resistant fiber, and 4) said thermoplastic fiber B is a fiber composed of polyphenylene sulfide.

2. The flame resistant woven fabric according to claim 1, further comprising a fiber C other than said non-melting fiber A and said thermoplastic fiber B, wherein, in the projection area of the weave repeat of said flame resistant woven fabric, an area ratio of said fiber C is 20% or less.

* * * * *